US008979297B2

(12) United States Patent
Statham

(10) Patent No.: US 8,979,297 B2
(45) Date of Patent: Mar. 17, 2015

(54) INSULATED CONTAINER WITH BUILT-IN ILLUMINATION

(75) Inventor: Larson Statham, Arlington, TX (US)

(73) Assignee: Larson Statham, Arlington, TX (US)

( * ) Notice: Subject to any disclaimer, the term of this patent is extended or adjusted under 35 U.S.C. 154(b) by 122 days.

(21) Appl. No.: 13/196,890

(22) Filed: Aug. 3, 2011

(65) Prior Publication Data

US 2013/0033854 A1 Feb. 7, 2013

(51) Int. Cl.
*F21V 33/00* (2006.01)
*F25D 27/00* (2006.01)

(52) U.S. Cl.
CPC ..... *F25D 27/00* (2013.01); *F25D 2700/02* (2013.01)
USPC ..... 362/154

(58) Field of Classification Search
CPC ..... B65D 81/38
USPC ..... 362/154
See application file for complete search history.

(56) References Cited

U.S. PATENT DOCUMENTS

| | | | | |
|---|---|---|---|---|
| 3,878,386 | A | 4/1975 | Douglas | |
| 4,390,928 | A | 6/1983 | Runge | |
| 4,754,376 | A | 6/1988 | Winslow | |
| 6,182,462 | B1 | 2/2001 | Bania et al. | |
| 6,438,983 | B1 | 8/2002 | Zellner et al. | |
| 6,749,319 | B1 | 6/2004 | Muse | |
| 6,786,614 | B2 | 9/2004 | Ciarrocchi, Jr. | |
| 7,018,062 | B2 | 3/2006 | Taylor | |
| 7,080,920 | B2 | 7/2006 | Fitzsimmons et al. | |
| 7,175,294 | B1 | 2/2007 | Estrada et al. | |
| 7,722,204 | B1 | 5/2010 | Sandberg | |
| 7,806,552 | B1 | 10/2010 | St. Julien | |
| 7,984,997 | B1 | 7/2011 | Sandberg | |
| 2002/0153816 | A1* | 10/2002 | Banicevic et al. | 312/404 |
| 2003/0071068 | A1 | 4/2003 | Burrows | |
| 2006/0042300 | A1* | 3/2006 | Kim | 62/348 |
| 2006/0097121 | A1 | 5/2006 | Fugate | |
| 2006/0227537 | A1 | 10/2006 | Vanderschuit | |
| 2006/0279947 | A1 | 12/2006 | Henley, Jr. et al. | |
| 2007/0217187 | A1 | 9/2007 | Blakely et al. | |
| 2009/0290331 | A1 | 11/2009 | Jacobs | |
| 2010/0212344 | A1 | 8/2010 | Mattucci | |
| 2010/0242520 | A1 | 9/2010 | Weir | |

* cited by examiner

*Primary Examiner* — Anh Mai
*Assistant Examiner* — Hana Featherly
(74) *Attorney, Agent, or Firm* — George M. Tompkins; Tompkins, P.C.

(57) ABSTRACT

Disclosed is an illuminated cooler with a light source positioned below an expected top level of contents of the cooler. A light source is preferably between two and six inches below an expected top level of contents. Most preferably, the cooler will comprise multiple lights arranged at varying heights within the cooler or a single light that provides light sources at a range of heights. The cooler may also comprise a switch to activate the lights when the cooler is opened, an ambient light sensor, and a processor.

12 Claims, 5 Drawing Sheets

INSULATED CONTAINER WITH BUILT-IN ILLUMINATION

TECHNICAL FIELD OF THE INVENTION

The present invention is generally directed to insulated containers of a type often used for storing food and beverages.

BACKGROUND ART OF THE INVENTION

Insulated containers (hereafter "coolers") are often used for storage of food and beverages when powered refrigeration is unavailable, or to provide temporary additional storage space. Some uses for coolers include camping, picnics, beach trips, and outdoor parties. In some applications, coolers are used at nighttime. Often, when coolers are used at nighttime, ambient illumination is insufficient to satisfactorily view the contents of the cooler. Thus, it would be helpful to provide illumination built into the cooler that would be convenient for viewing the contents and would be readily available when needed.

Although coolers with built-in illumination are known, prior art coolers have relied on top-down illumination, that is, a light source located above the expected level of ice, beverages, foods, and/or other items in the cooler. Most of the light provided by such illumination merely reflects off the top surface of the contents, providing only limited illumination. It has been found that providing illumination from a point below the top level of the ice and other contents results in better illumination of the contents and also provides a visually pleasing "glowing" effect. What is needed is a cooler with built-in illumination that provides illumination from a point below a top layer of contents and preferably continues to provide illumination from below the top layer of contents over a range of fill levels of the cooler.

SUMMARY

Problems with prior art coolers are solved by providing a cooler with lights configured to illuminate the cooler from a position below the expected top layer of contents. In one embodiment, lights are provided which illuminate the cooler from multiple vertical positions in the cooler, so that illumination will be provided below the top layer of contents even when the cooler is only partially full. In another embodiment, the lights are connected to a switch configured to illuminate the lights when the cooler is open. In another embodiment, the lights are coupled to an ambient light sensor and configured to provide illumination when it is dark. In another embodiment the lights are controlled by a processor.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE PREFERRED EMBODIMENTS

Figure 1:
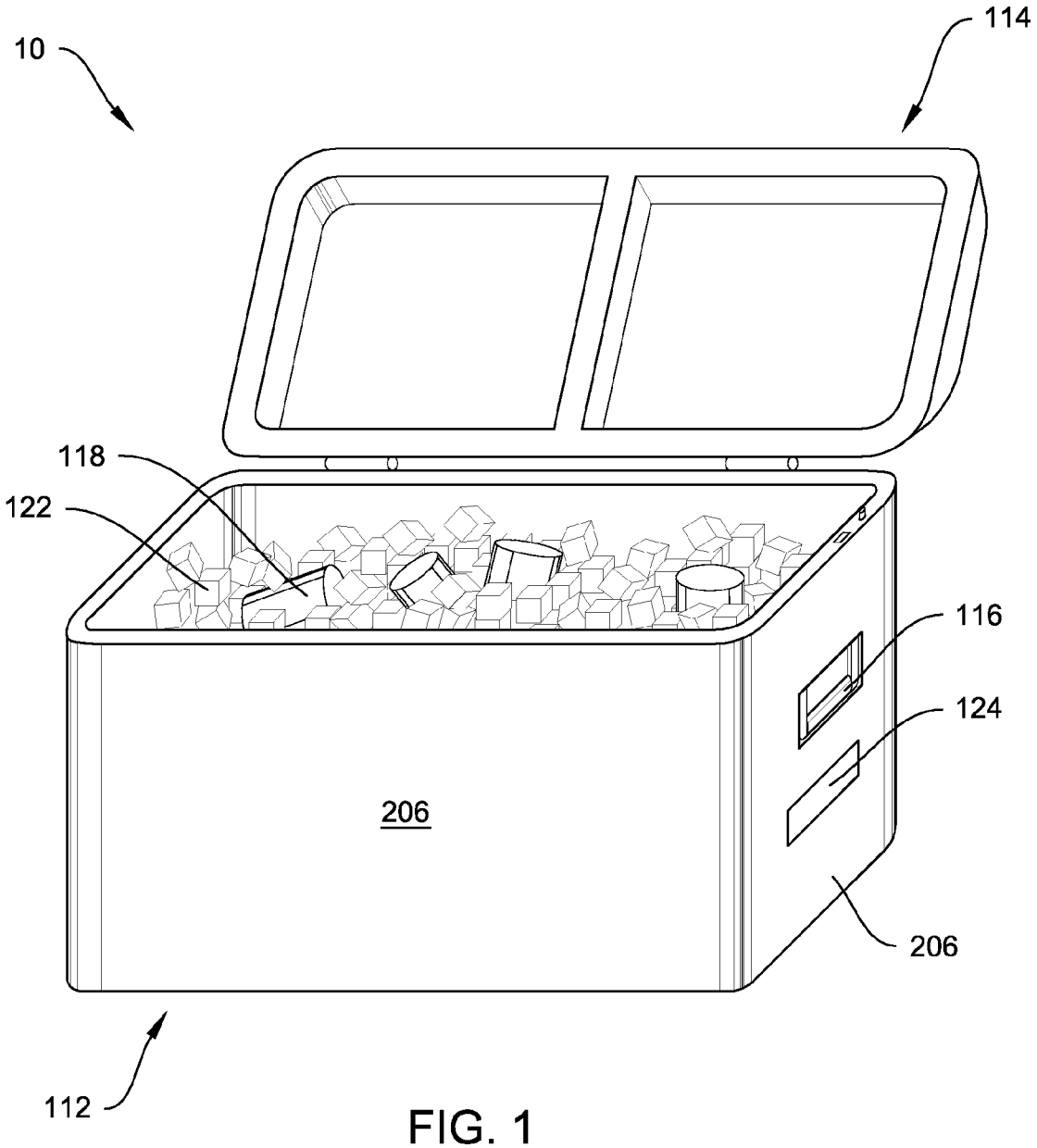
FIG. 1 is a perspective view an illuminated cooler.

FIG. 1 shows a cooler 10 of a type that may be used to store food or beverages. Cooler 10 comprise a tub 112 and a lid 114. Tub 112 preferably includes carrying handles 116 and may comprise wheels (not shown) and an extendable handle (not shown) to facilitate rolling. Tub 112 and lid 114 are preferably insulated. Tub 112 and lid 114 are preferably insulated by double-wall insulation, with an insulating material such as a polyurethane foam sandwiched between two layers of a durable material such as polypropylene. However, many other insulating materials and methods of cooler construction are known and may be used, such as a single layer of polystyrene foam. Cooler 10 is shown configured as a generally rectangular box with four sidewall panels 206. During use, cooler 10 is preferably filled with beverages 118, food (not shown), water (not shown), ice 122, and/or other items (collectively "contents").

When a light source for a cooler 10 is located above the top layer of contents, most of the light is reflected off of the contents. However, when a light source is below but near the top layer of contents, a significant portion of the light refracts and reflects through ice 122 and water in cooler 10, causing the contents to appear to glow, giving a visually-pleasing appearance, and providing better illumination. Accordingly, cooler 10 is preferably illuminated by a light source located below an expected top layer of contents. Most preferably, cooler 10 is lighted from light sources positioned at multiple heights within tub 112. The multiple light sources may be from a single light-producing module or from multiple light-producing modules.

Figure 2:
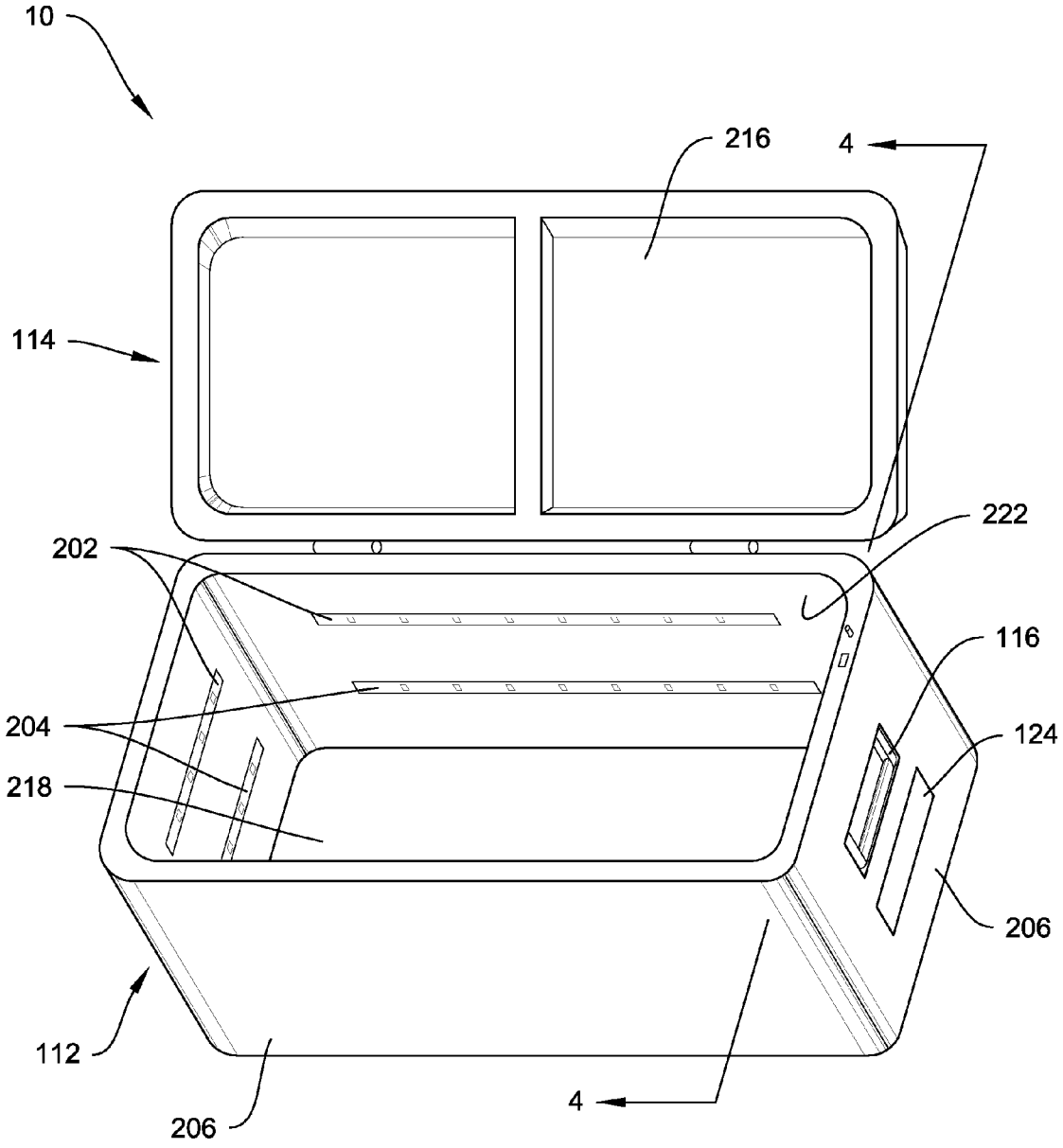
FIG. 2 is a perspective view of an illuminated cooler showing a potential light placement.

Referring to FIG. 2, interior illumination for cooler 10 may be provided using upper lights 202 and lower lights 204 located on one or more sidewall panels 206 of tub 112. Preferably, upper lights 202 and lower lights 204 are positioned on all sidewall panels 206 of tub 112. Upper lights 202 are preferably positioned at a vertical height on sidewall panels 206 such that upper lights 202 will be below a top layer contents when tub 112 is relatively full. Lower lights 204 are preferably positioned at a vertical height on sidewall panels 206 below upper lights 202 such that lower lights 204 will be below a top layer of contents when tub 112 is approximately half full. As an example, lower lights 204 may be positioned at a point that is ⅓ of the height of sidewall panel 206 and upper lights 202 may be positioned at a point that is ⅔ of the height of sidewall panel 206.

Upper light 202 is preferably positioned between about ½ inches and six inches below an expected position of the top layer of contents at maximum cooler 10 fill level, which is generally the top of tub 112. More preferably, upper light 202 is positioned between about 2 inches and about five inches below the expected position of the top layer of contents. Most preferably, upper light 202 is positioned about 4 inches below the expected position of the top layer of contents. Lower lights 204 are preferably positioned between about 2 inches and about 6 inches below upper lights 202. For a cooler 10 with a tub 112 depth of about 12 inches, placing upper lights 202 at a point about 4 inches below the top of tub 112 and placing lower lights 204 at a point about 8 inches below the top of tub 112 has been found to provide satisfactory results. In a cooler 10 with a deeper tub 112, additional levels of lights may be necessary for optimal results. Additional levels of lights are preferably placed between about 2 inches and about 6 inches below the preceding level. Additional lights (not shown) may also be placed on the bottom 218 of cooler 10 or at an intersection of bottom 218 and a sidewall panel 206 to provide bottom-up illumination when only a small amount of contents are in cooler 10.

Figure 6:
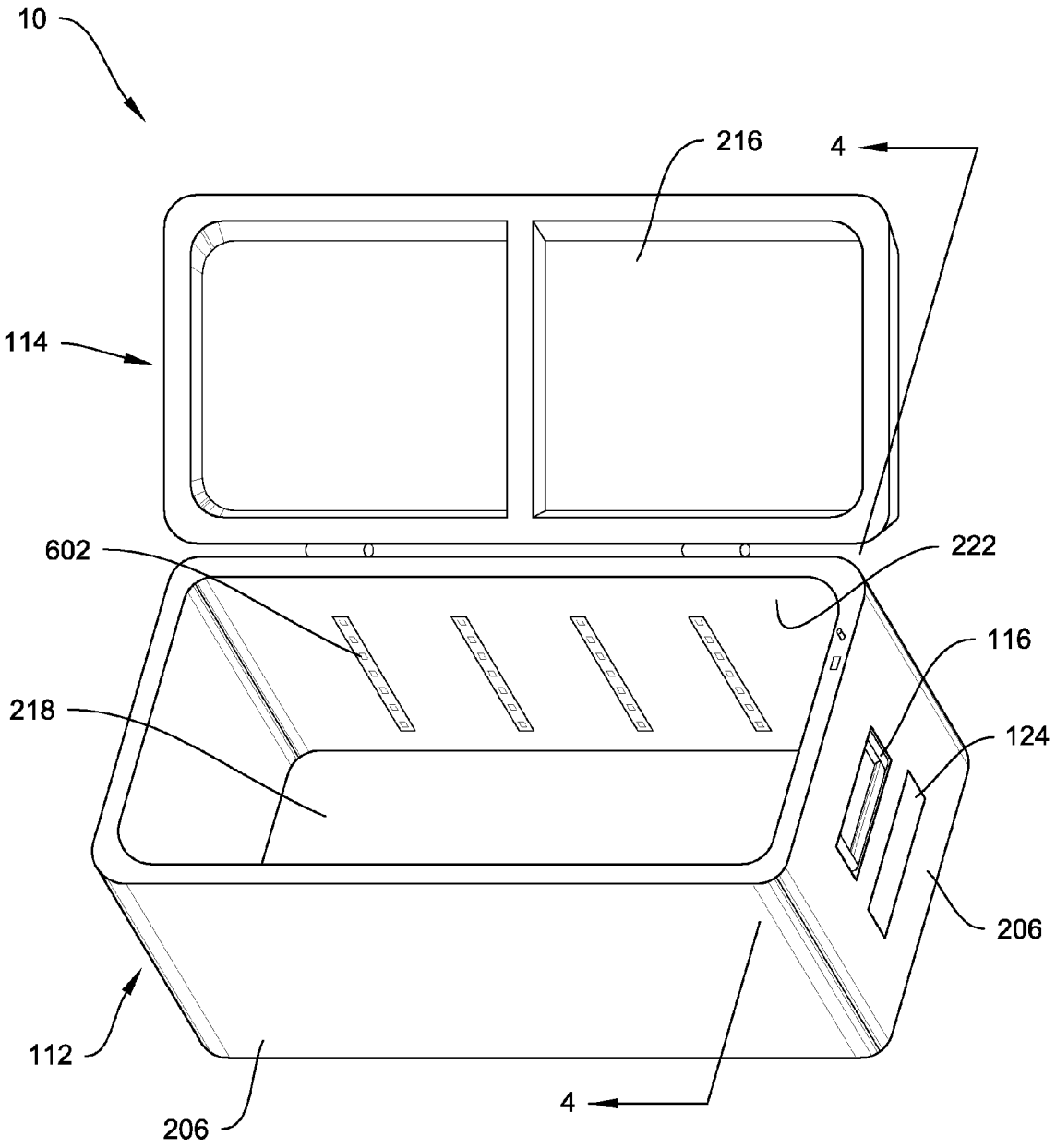
FIG. 6 is a perspective view of an alternative embodiment of an illuminated cooler.

The described embodiment of two rows of lights is useful because it represents a relatively inexpensive yet effective method of achieving the desired illumination over a range of fill levels of the cooler. However, an infinite number of other possible light placements may be used in the alternative. Alternative light placement will generally provide acceptable illumination as long as some of the lights are located at a position that will be below a top level of contents in tub 112 but will be near enough to the top layer of ice 122 to allow significant light to escape through the contents. In an alternative embodiment, shown in FIG. 6, light strips 602 are oriented vertically, providing substantially continuous light along at least a portion of the height of tub 112. In another example a light panel (not shown) may be used which provides light from an area covering at least a portion of the height of tub 112. In another example, a plurality of independent light sources may be provided at a different locations and heights. For coolers with a larger distance between sidewalls panels 206, lights may also be provide in intermediate locations, such as on columns (not shown) extending up from bottom 218. In addition, other lights may be used, such as lights (not shown) positioned on an inner surface 216 of lid 114.

An inner wall 222 of tub 112 preferably comprises a transparent or translucent material. A transparent or translucent inner wall 222 allows upper lights 202, lower lights 204 and/or other lights to be positioned outside tub 112, between inner wall 222 and outer wall 224. This configuration allows the lights to illuminate the interior of tub 112 through inner wall 222, while inner wall 222 protects the lights from exposure to water or contents and avoids the need to provide electrical connections through inner wall 222. Most preferably, inner wall 222 is blow molded from a single piece of transparent or translucent plastic, such as clear polypropylene. Alternatively, upper lights 202 and lower lights 204 as well as any other lights in tub 112 may be attached to inner wall 222 in the interior of tub 112, in which case the lights are preferably waterproof, and any electrical connections extending through inner wall 222 of tub 112 are preferably sealed with water-tight seals.

Figure 3:
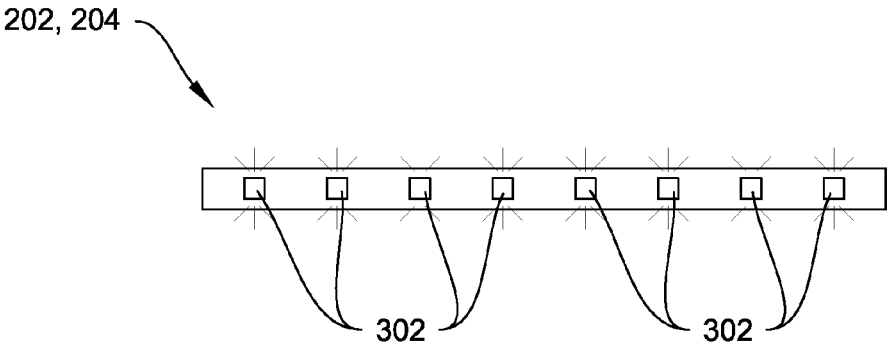
FIG. 3 is a closer view of a light that may be used to illuminate a cooler.

Referring to FIG. 3, Upper lights 202 and lower lights 204 are preferably configured as one or more rows of light elements 302, with a plurality of light elements 302 in each row. Light elements 302 may be light-emitting diodes (LEDs), incandescent bulbs, fluorescent bulbs, organic light-emitting diodes (OLEDs), or other light source. Preferably, light elements 302 are LEDs because they are energy efficient, long-lasting, durable, and do no create excess heat, which would tend to melt ice 122. In the preferred embodiment, light elements 302 emit white light. Alternatively, light elements 302 may be configured to emit light of some other color or colors, or filters (not shown) may be used to provide light of a particular color. In one embodiment, light elements 302 emit light of a color associated with a sports team and cooler 10 may be decorated with indicia (not shown) associated with the sports team.

Figure 4:
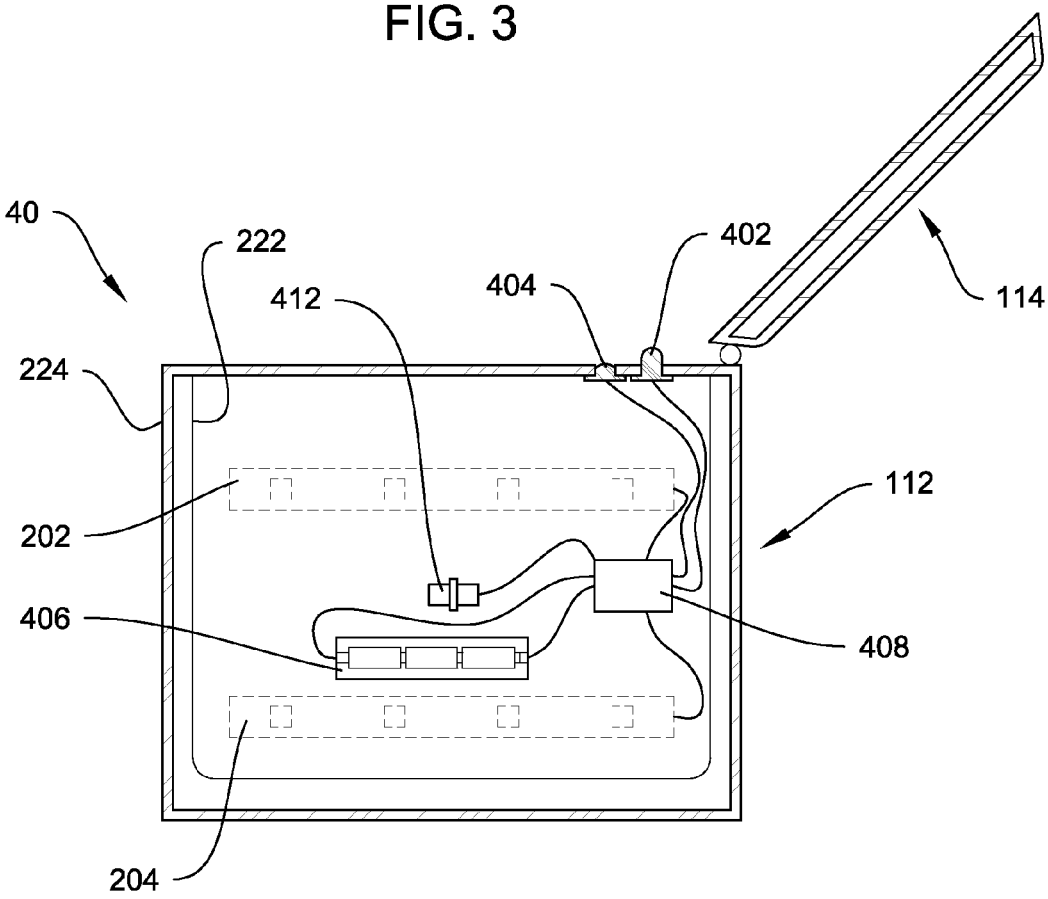
FIG. 4 is section view, taken along line 4-4 of FIG. 2, showing an arrangement of an electrical system within a wall of a cooler.

FIG. 4 shows an electrical system 40 that may be used in connection with the present invention. Electrical system 40 preferably comprises an automatic switch 402 that is configured to detect whether lid 114 is open. Most preferably, automatic switch 402 is a pressure switch configured so that pressure provided by closed lid 114 will hold automatic switch 402 in the "off" (open circuit) position, while a spring or other biasing means will push the switch to its "on" (closed circuit) position when lid 114 is open. Electrical system 40 also preferably comprises a light sensor 404, which is able to sense the level of ambient light around cooler 10 and to activate upper lights 202 and lower lights 204 when illumination is necessary. Light sensor 404 is preferably positioned on a top surface of tub 112, near automatic switch 402, but may alternatively be placed within the interior of tub 112. Alternatively to providing automatic switch 402, light sensor 404 may be used to determine whether lid 114 is open.

Electrical system 40 includes a power source 406, which may be a dry-cell battery such as "D-cell" batteries. However, many other sources of electrical power are known and may be used. Electrical system 40 may also comprise a manual switch 412 which may be accessible from the outside of cooler 10 through compartment 124 (see FIG. 1 or 2) or other possible openings (not shown). Electrical system 40 preferably includes a controller 408 which controls other components of electrical system 40. Controller 408 is conductively connected to automatic switch 402, light sensor 404, power source 406, manual switch 412, upper lights 202, and lower lights 204, e.g., by copper wires. Alternatively, electrical system 40 may be used without controller 408, in which case operation of upper lights 202 and lower lights 204 will be controlled by automatic switch 402, manual switch 412, and/or light sensor 404.

Electrical system 40 may also comprise contents level sensors (not shown) which could be used to determine the level of contents in tub 112 of cooler 10. Preferably, a contents level sensor would be connected to one or more of upper lights 202 or lower lights 204. When a contents level sensor associated with upper lights 202, for example, senses that the top level of contents is below upper lights 202, upper lights would not be illuminated, thereby saving energy and increasing the glowing effect provided by other lights.

The components of electrical system 40 are preferably positioned within a sidewall panel 206 of tub 112, i.e. between the inner wall 222 and outer wall 224, if double-wall insulation is used. If batteries are used as power source 406, power source 406 is preferably is positioned in a location that may be easily accessed from outside of cooler 10, so that the batteries may be replaced or removed for charging. Power source 406 may be placed in a compartment 124 (see FIG. 1 or 2) defined in a sidewall panel 206 of tub 112.

Figure 5:
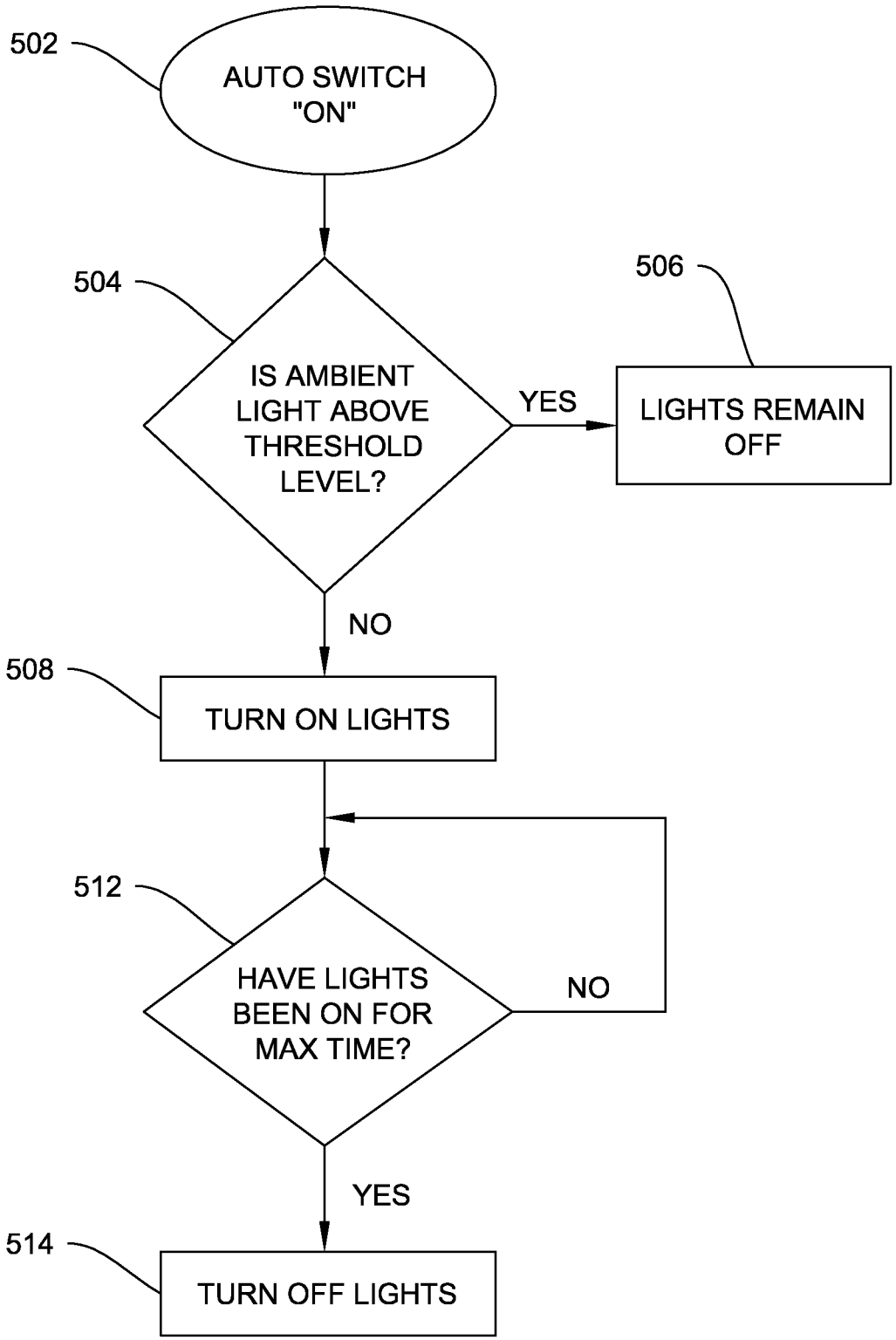
FIG. 5 is a flow chart illustrating a potential control process for an illuminated cooler.

FIG. 5 is a flow chart showing steps that may be performed by controller 408. These will be performed if manual switch 412 is in the "on" position. In step 502, controller 408 is activated when lid 114 of cooler 10 is opened and automatic switch 402 is in the on position. Next, in step 504, controller 408 receives data from light sensor 404 and determines whether the ambient light is above a threshold light level. The threshold light level is preferably a light level above which illumination is unnecessary. If controller 408 determines that the ambient light level is above the threshold light level, then, in step 506, upper lights 202 and lower lights 204 remain off and the process terminates until cooler 10 is opened again. It is anticipated that the disclosed invention will most commonly be used in applications where cooler 10 will only be opened for short periods at a time. In such applications, it is unnecessary for controller 408 to reevaluate the ambient light level, as it is unlikely to have changed while lid 114 of cooler 10 is open. In other applications, it may be necessary to revert to step 504 to reevaluate the ambient light level.

If the ambient light level is below the threshold light level then, in step 508, controller 408 illuminates upper lights 202 and lower lights 204. In most applications, it would be beneficial to only illuminate upper lights 202 and lower lights 204 for a predetermined time period before turning them off to save batteries or other power in the event cooler 10 is accidently left open or lid 114 does not close completely. Therefore, in step 512, controller determines whether upper lights 202 and lower lights 204 have been illuminated for a maximum time. If the lights have not been illuminated for the maximum time, controller 408 continues to check the time until the maximum time is reached. If lights 202 and 204 have been illuminated for the maximum time, then in step 514, controller 408 turns off upper lights 202 and lower lights 204 and the process is terminated.

Although the invention has been described with reference to specific embodiments, this description is not meant to be construed in a limiting sense. Various modifications of the disclosed embodiments, as well as alternative embodiments of the inventions, will be apparent to persons skilled in the art upon reference to the description of the invention. It is, therefore, contemplated that the appended claims will cover such modifications that fall within the scope of the invention.

I claim:

1. An illuminated insulated container comprising:

a tub with an inner wall and an outer wall;

a space defined between the inner wall and the outer wall;

an insulating material occupying at least a portion of the space; and lights positioned between the inner wall and the outer wall and configured to provide illumination within the tub.

2. The illuminated insulated container of claim 1 wherein the first light source comprises a light-emitting diode.

3. The illuminated insulated container of claim 1 wherein the first light source comprises a strip of light-emitting diodes.

4. The illuminated insulated container of claim 1 wherein the insulated container further comprises a second light positioned between 2 inches and 6 inches below the first light.

5. The illuminated insulated container of claim 4 wherein the first and second lights are provided by a strip of light-emitting diodes that extends along a vertical segment of the wall.

6. The illuminated insulated container of claim 4 wherein the first and second lights are provided by a light panel that extends along a vertical segment of the wall.

7. The illuminated insulated container of claim 1 further comprising:

a lid configured to selectively cover the opening; and a switch configured to illuminate the light when the lid is not covering the opening.

8. The illuminated insulated container of claim 1 further comprising a second light positioned on the bottom or at an intersection of the wall at the bottom.

9. The illuminated insulated container of claim 1 wherein the light is positioned between ½ and 6 inches below the expected top layer of items.

10. The illuminated insulated container of claim 1 wherein the light is positioned between 2 and 5 inches below the expected top layer of items.

11. The illuminated insulated container of claim 1 wherein the inner wall comprises a transparent or translucent material.

12. The illuminated insulated container of claim 1 wherein the insulating material comprises a polymer foam.

* * * * *